US007108247B2

(12) United States Patent
Wechsler

(10) Patent No.: US 7,108,247 B2
(45) Date of Patent: Sep. 19, 2006

(54) METHOD AND APPARATUS FOR LIFTING AND/OR CONVEYING

(75) Inventor: Helmut Wechsler, Stein (DE)

(73) Assignee: Sympat GmbH, Nürnberg (DE)

( * ) Notice: Subject to any disclaimer, the term of this patent is extended or adjusted under 35 U.S.C. 154(b) by 74 days.

(21) Appl. No.: 10/911,834

(22) Filed: Aug. 4, 2004

(65) Prior Publication Data

US 2005/0029500 A1 Feb. 10, 2005

(30) Foreign Application Priority Data

Aug. 5, 2003 (DE) ..... 103 35 701

(51) Int. Cl.
*B66D 1/30* (2006.01)

(52) U.S. Cl. ..... 254/371; 242/602

(58) Field of Classification Search ..... 254/371–374; 242/444.1, 444.2, 444.5, 602
See application file for complete search history.

(56) References Cited

U.S. PATENT DOCUMENTS

| | | | | |
|---|---|---|---|---|
| 1,278,993 | A * | 9/1918 | Parks | 336/206 |
| 1,840,139 | A * | 1/1932 | Turner | 336/205 |
| 2,195,233 | A * | 3/1940 | Boyer | 336/205 |
| 2,558,566 | A * | 6/1951 | Jorgensen | 242/444.1 |
| 3,153,180 | A * | 10/1964 | Bellmore | 361/307 |
| 3,224,697 | A | 12/1965 | Struble | |
| 3,534,542 | A * | 10/1970 | West | 57/221 |
| 3,576,295 | A * | 4/1971 | Hale | 242/388.8 |
| 4,141,515 | A * | 2/1979 | Lock et al. | 242/523.1 |
| 4,417,701 | A * | 11/1983 | Moritz | 242/431 |
| 5,012,565 | A * | 5/1991 | Gillet | 29/25.42 |
| 5,664,736 | A * | 9/1997 | Murakoshi et al. | 242/444.2 |
| 5,792,294 | A * | 8/1998 | Randazzo et al. | 156/94 |
| 6,170,775 | B1 * | 1/2001 | Kovacik et al. | 242/404 |
| 6,412,730 | B1 * | 7/2002 | Shimazaki | 242/602 |
| 6,443,383 | B1 * | 9/2002 | Stasny et al. | 242/388 |

FOREIGN PATENT DOCUMENTS

| | | |
|---|---|---|
| DE | 548 624 C | 3/1932 |
| DE | 1 802 719 A | 5/1969 |
| DE | 33 02 378 C2 | 8/1984 |
| DE | 197 36 387 C2 | 3/1998 |
| DE | 100 33 626 A | 1/2002 |
| EP | 0 825 624 B1 | 3/1998 |
| GB | 2 136 759 A | 8/1984 |
| JP | 2003118982 | 4/2003 |
| WO | WO 02/04081 A | 1/2002 |

* cited by examiner

*Primary Examiner*—Emmanuel M Marcelo
(74) *Attorney, Agent, or Firm*—Kathleen T. Petrich

(57) ABSTRACT

The invention relates to a method of operation of and apparatus for a lifting and/or conveying device (1), such as a crane, that comprises at least one cable (2) capable of being rolled (wound) onto or off a dispenser roll (3). To lengthen the service lifetime of the cable, a separation medium (4) is introduced between individual windings (5, 5', 5") of the cable (2) on the dispenser roll (3) during operation. The separation medium prevents at least partial contact, and, preferably all contact, between the individual windings thereby reducing contact wear. According to one aspect of the invention, the separation medium is a plastic web that may be wound onto the individual windings via a separation media roll (6).

25 Claims, 2 Drawing Sheets

METHOD AND APPARATUS FOR LIFTING AND/OR CONVEYING

RELATED APPLICATION

The present application claims priority to German Patent Application No. 103 35 701.7, filed Aug. 5, 2003, and entitled "Process for the Operation of a Lifting and Conveying Device as well as a Lifting and Conveying Device" [translated into English].

TECHNICAL FIELD

The present invention relates generally to lifting and conveying devices, such as cranes, and the method of operating such lifting devices and conveying devices.

BACKGROUND OF THE INVENTION

Lifting and/or conveying devices, and, particularly cranes, utilize a pull cable, typically made of steel, to lift a load or to convey some load. In order to position the load accordingly, the cable is wound onto or off of a dispenser roll (or drum) that is driven by an electrical motor. However, in use, wound-on steel cables with lifting and/or conveying devices have been shown to have a reduced service lifespan that is significantly less than conventional unwound cables. It is conjectured that a cable used during the winding process digs into the cable windings already wound on the dispenser roll. This digging action causes the individual cable windings, already on the dispenser roll, to have low-level metallic grinding contact. With renewed rolling of the cable off the dispenser roll, this low-level metallic grinding contact is present when the cable is wound off the dispenser roll. Over time, the steel material of the cable becomes damaged and the overall cable's lifespan becomes limited.

The objective of the invention is to significantly lengthen the service lifetime of the cable during use. In particular, it is an objective to treat the cables so that damage to the cables is limited or, preferably eliminated, leading to an enhanced cable lifespan.

SUMMARY OF THE INVENTION

The invention relates to a method and apparatus for the operation of a lifting and/or conveying device, in particular a crane, that comprises at least one cable that has individual windings. The cable can be wound, or rolled, onto or off a dispenser roll. A separation medium is applied between the individual cable windings while the cable is being wound onto the dispenser roll. The separation medium prevents at least partial contact between the individual cable windings, and preferably complete or nearly complete contact between the individual cable windings.

In preferred form, the separation medium is made of plastic, such as thermo-plastic or duro-plastic material. The separation medium may be in the form of a strip-line plane or a bent web. In a further preferred form, the separation medium is wound between the individual windings by a separation media roll associated with the dispenser roll.

According to one aspect of the invention, a synchronization means may be employed that synchronizes rotary motion of the separation medium roll with that of the dispenser. Moreover, a guide device may be employed in which to feed the separation medium to the dispenser roll.

In a preferred embodiment, the separation medium is removed from the cable and for its windings during winding or rolling off the dispenser roll, in particular by winding the separation medium again on the separation medium roll.

These and other features and benefits will be discussed in further detail in the various figures of the attached drawings, the Brief Description of the Drawings, and the Best Mode for Carrying Out the Invention.

BRIEF DESCRIPTION OF THE DRAWINGS

Like reference numerals are used to designate like parts throughout the several views of the drawings, wherein.

BEST MODE FOR CARRYING OUT THE INVENTION

The lifting and/or conveying device according to the invention, in particular a crane, comprises at least one cable having individual strands which are wound (or rolled) onto or off a dispenser roll in order to lift or convey (move) a load. A separation medium is applied between the individual strands in the winding process to reduce wear and improve lifespan of the cable.

If the load 11 is to be moved vertically upwards, the wire cable 2 must be wound onto the dispenser roll 3 accordingly. In this case, the strip-like or web-like separation medium 4 is introduced between the individual windings of the wire cable 2, while on the dispenser roll 3 to prevent at least partial metal contact between the windings of the cable.

Figure 1:
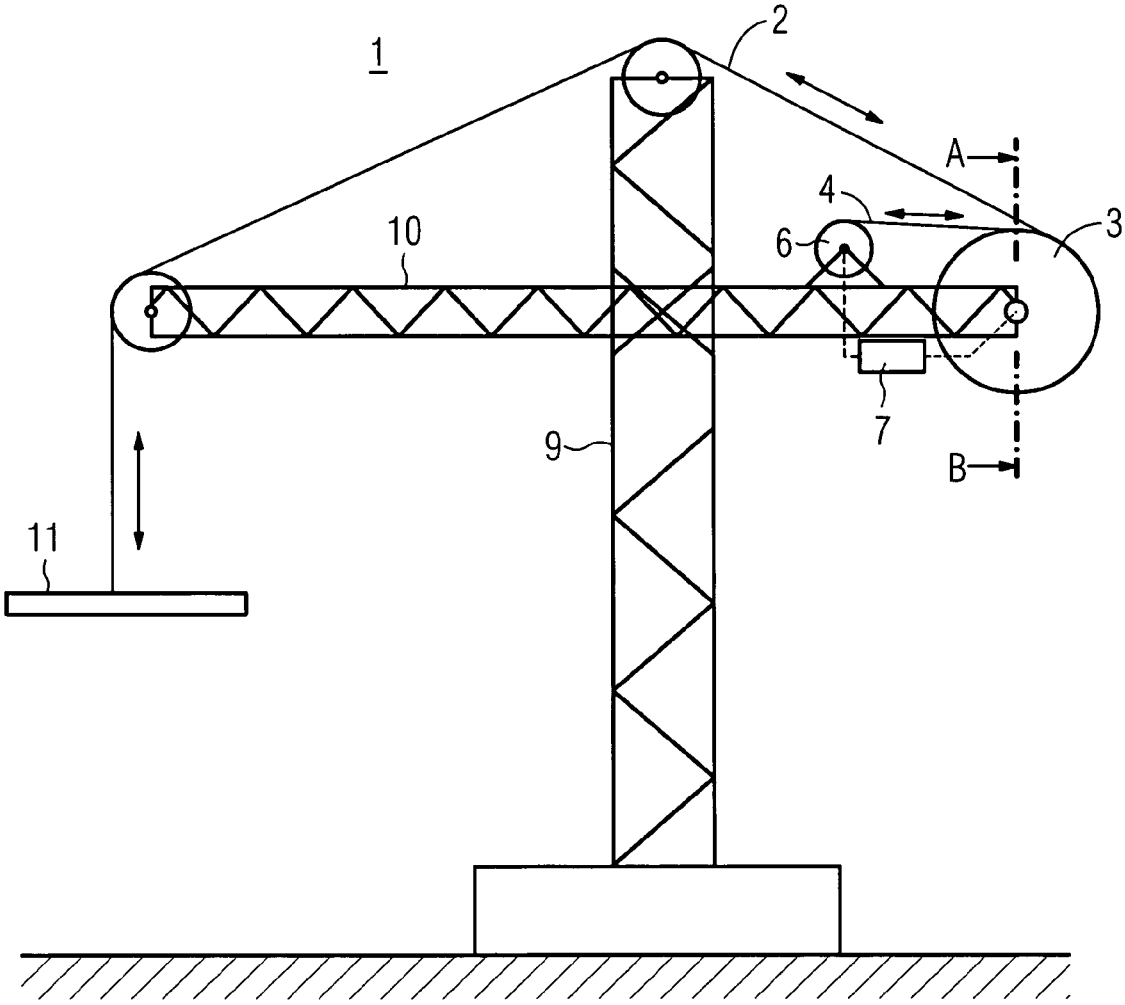
FIG. 1 is a front schematic view of a preferred embodiment lifting device of the present invention.
Figure 2:
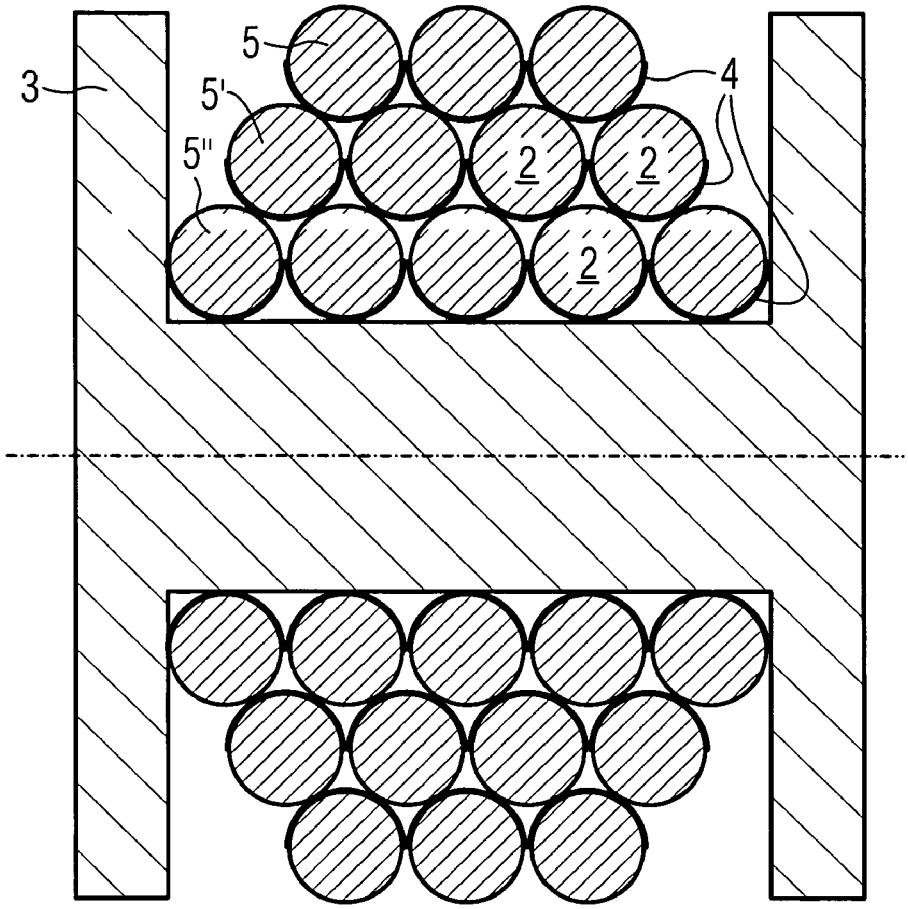
FIG. 2 is a section view taken substantially across lines A–B of FIG. 1 illustrating the dispenser roll of the lifting device.
Figure 3:
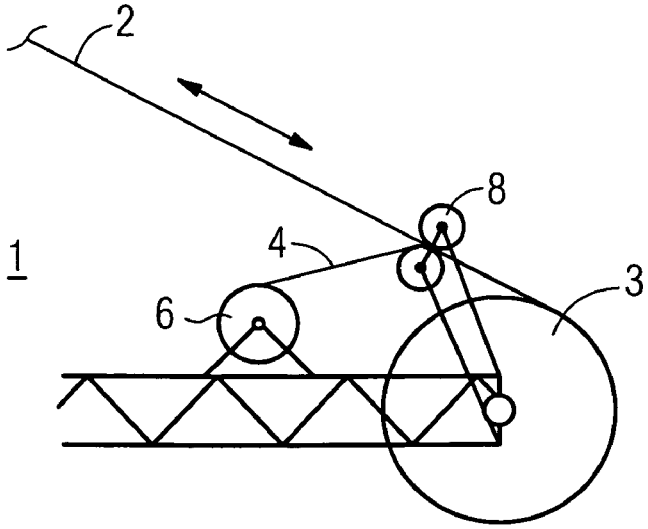
FIG. 3 is a front enlarged schematic view of the lifting device shown in an alternate position.

Referring to FIGS. 1–3, FIG. 1 discloses a preferred lifting/conveying device (e.g. a crane) 1 in lateral view. The crane typically comprises a main vertical beam 9 and a substantially horizontal beam 10, relative to the vertical beam 9. A load 11 is fastened to a wire cable 2 and may be moved vertically up and down or side ways by wire cable 2 being wound onto and off a dispenser roll 3. Not represented are electrical drive means that turn the dispenser roll 3 at a predefined speed of rotation and predefined angle of rotation, which would be well known to one of ordinary skill in the art.

On the beam 10, along with the dispenser roll 3, is an additional roll that is a separation media roll 6 and is discussed in further detail below. The separation medium 4 is preferably endlessly extruded from the separation media roll 6.

Referring now to FIG. 2, the section view taken across lines A–B of FIG. 1, illustrates how individual windings 5, 5', 5" of the wire cable 2 are wound onto the dispenser roll 3. The separation medium 4, such as a bent web or strip-like plane, are wound onto the individual cable strands 5, 5', 5" during the winding process. The plastic web 4 is wound onto a separation media roll 6 associated with the dispenser roll 3. In the process of winding the plastic web onto the dispenser roll, the medium (plastic web) may be laid in the form of a semi-circle below each strand onto cable 2. As illustrated in FIG. 2, it follows that once the separation medium is applied to and lies between the individual windings 5, 5', 5" of the cable 2, contact wear between the strands is reliably prevented. Thus, the lifespan of the cable is significantly increased.

In principle, any type of plastic comes into consideration as material for the separation medium. In preferred form, the separation medium is a plastic made by the Elastogran company under the trademark ELASTOLLAN.

Referring also to FIG. 3, the strip-like separation medium 4 is guided from its separation media roll 6, during the winding of the cable 2 onto the dispenser roll 3, via a guide device 8. The guide device is illustrated schematically in FIG. 3 and causes the plastic strip or web 4 to be brought exactly or near exactly "under" the cable 2 during rolling of the cable 2 onto the dispenser roll 3. In this manner, the guide assists to lay out the strip or web into the semi-circle arrangement around and under the individual strands 5, 5', 5" when the cable is wound onto the dispenser roll 3, as illustrated in FIG. 2.

While the separation medium (e.g., plastic strip or web) 4 is wound off the separation media roll 6 during the winding of cable 2 onto the dispenser roll 3, this process is correspondingly reversed in the winding of cable 2 off the dispenser roll 3. In this case, the separation medium (plastic web or strip) 4 is, therefore, wound back onto the separation media roll 6.

It is important for good function of the process explained that the separation medium 4 in the form of a plastic strip is guided precisely under cable 2 near dispenser roll 3 at that speed at which it is wound onto dispenser roll 3. For this purpose, synchronization means 7 are provided. The synchronization means are schematically represented in FIG. 1. The means can be mechanical gears that ensure that the separation medium 4 is fed precisely at the rolling-on speed of cable 2.

The synchronization means may also be electronic in nature. In this case, the separation media roll 6 can be driven by an electrical motor, preferably a servomotor, that receives its angle of rotation or speed of rotation signals from a path or speed measurement sensor that measures the position or the speed of the cable 2 during rolling of the cable 2 onto the dispenser roll 3.

According to other aspects of the invention, the separation medium may be applied to the individual windings 5, 5', 5" of the cable from the beginning of the winding process. Additionally, and as discussed above, the cable has the separation medium coating over at least a part of its circumference, such as the semi-circle arrangement disclosed in FIG. 2. However, the invention (both method and in apparatus forms) may include where the individual strands are completely coated (similar to FIG. 2, except with the coating about the individual windings shown in section in a full circle). The separation medium can, in this case, completely enshroud the cable. However, it can also be provided that the separation medium enshrouds the cable only over a predefined circumferential area.

With the separating medium, any direct contact of the individual cable windings is therefore, at least substantially, prevented. No high surface pressing of metal against metal occurs, so that a pointwise welding or micro-contact wear of the individual metallic cable windings is ruled out. Thereby, the service lifetime of the cable is significantly increased by up to a factor of 50.

In another form of the invention, the cable itself may be supplied with the separation medium so that the desired effect of spacing of the individual cable windings on the dispenser roll is ensured uniformly.

The proposal according to the invention can be used anywhere steel cable has to be wound on and off in lifting and/or conveying devices, thus in all types of cranes, crane trucks, winches, and so on.

The main advantage of the present invention is the significant lengthening of service lifetime. The illustrated embodiments are only examples of the present invention and, therefore, are non-limitive. It is to be understood that many changes in the particular structure, materials, and features of the invention may be made without departing from the spirit and scope of the invention. Therefore, it is the Applicant's intention that its patent rights not be limited by the particular embodiments illustrated and described herein, but rather by the following claims interpreted according to accepted doctrines of claim interpretation, including the Doctrine of Equivalents and Reversal of Parts.

What is claimed is:

1. A method for operating a crane having at least one cable having individual windings, said cable being capable of being wound onto and off a dispenser roll in a rotary motion, the method comprising:

winding the cable onto the dispenser roll;

introducing a separation medium between the individual windings cable while the cable is winding onto the dispenser roll;

whereby at least partial contact is prevented between the individual cable windings and further comprising winding the cable off the dispenser roll and removing the separation medium from the cable and/or its windings.

2. The method according to claim 1 wherein the separation medium results in the prevention of complete contact between the individual cable windings.

3. The method according to claim 2 wherein the section view of a cable winding having the separation medium applied to it is in the shape of a circle.

4. The method according to claim 1 wherein the separation medium is formed as a strip like plane.

5. The method according to claim 4 wherein the separation medium is wound between the individual windings by a separation media roll.

6. The method according to claim 1 wherein the separation medium is formed as a bent web.

7. The method according to claim 6 wherein the bent web is made of a thermoplastic material.

8. The method according to claim 6 wherein the bent web is made of a duroplastic material.

9. The method according to claim 1 wherein the separation medium is wound between the individual windings by a separation media roll having rotary motion.

10. The method according to claim 9 wherein the rotary motion of the dispenser roll is synchronized with the rotary motion of the separation media roll via synchronization means.

11. The method according to claim 10 wherein the synchronization means is through mechanical gears.

12. The method according to claim 10 wherein the synchronization means is through a servomotor.

13. The method according to claim 9 further comprising winding the cable off the dispenser roll and where the separation medium is wound back onto the separation media roll.

14. The method according to claim 1 wherein the section view of a cable winding having the separation medium applied to it is in the shape of a semi-circle.

15. A lifting and/or conveying device capable of lifting or conveying a load, the device comprising:

at least one cable to having individual windings, said cable being capable of being wound onto and off a dispenser roll in a rotary motion;

a separation medium enshrouding at least a portion of the individual windings; and wherein the lifting/conveying device is a crane.

16. The device according to claim 15 wherein the separation medium is formed of plastic.

17. The device according to claim 16 wherein the separation medium is a strip-like plane.

18. The device according to claim 15 wherein the separation medium is provided by a separation media roll having rotary motion.

19. The device according to claim 18 wherein the rotary motion of the separation media is synchronized by synchronization means.

20. The device according to claim 19 wherein the synchronization means is a plurality of mechanical gears.

21. The device according to claim 19 wherein the synchronization means is a servomotor.

22. The device according to claim 15 further comprising a guide device.

23. The device according to claim 15 wherein the separation medium is made from a thermoplastic material.

24. The device according to claim 15 wherein the separation medium is made from a duroplastic material.

25. The device according to claim 15 wherein the separation medium enshrouds a predefined area of the individual windings.

* * * * *